United States Patent [19]

Hollingsworth

[11] 4,251,894

[45] Feb. 24, 1981

[54] SELF-ADJUSTING SWIM FIN STRAP

[75] Inventor: Ashley J. Hollingsworth, Atherton, Calif.

[73] Assignee: Farallon Industries, Inc., San Leandro, Calif.

[21] Appl. No.: 760,683

[22] Filed: Jan. 19, 1977

[51] Int. Cl.[3] ..... A63B 31/11

[52] U.S. Cl. ..... 9/309

[58] Field of Search ..... 9/309, 301-306, 9/310 AA; 24/257 R; 280/11.3, 11.31, 619, 620; 267/69, 73, 74

[56] References Cited

U.S. PATENT DOCUMENTS

| | | | |
|---|---|---|---|
| 2,779,077 | 1/1957 | Kline | 9/309 |
| 2,987,834 | 6/1961 | Howe | 280/11.3 |
| 3,302,222 | 2/1967 | Ferraro | 9/309 |

FOREIGN PATENT DOCUMENTS

| | | | |
|---|---|---|---|
| 893564 | 8/1944 | France | 267/74 |
| 316433 | 11/1956 | Switzerland | 280/619 |

*Primary Examiner*—Sherman D. Basinger

*Attorney, Agent, or Firm*—Lowhurst & Aine

[57] ABSTRACT

A foot retaining strap for a swim fin having a pocket for receiving a wearer's foot. The strap includes a spring laced through a molded neoprene heel pad for comfort. The ends of the springs are secured to opposite sides of the foot pocket opening of the swim fin. The wearer's foot is held in the pocket under tension of the spring which holds the foot pad against the wearer's heel. Overstretching of the spring is prevented by a non-stretchable cord strung inside the spring, with the ends of the cord also affixed to the sides of the fin. The length of the cord is such that it prevents the spring from being stretched beyond its elastic limit.

4 Claims, 3 Drawing Figures

SELF-ADJUSTING SWIM FIN STRAP

BACKGROUND OF THE INVENTION

The invention relates to swim fins such as are used by underwater swimmers and more particularly to means for holding the wearer's foot in a pocket provided in the swim fin.

DESCRIPTION OF THE PRIOR ART

Swim fins or "flippers" include a foot pocket portion and a blade extending forwardly from the foot which increases the area coming in contact with the water to thus provide greater power for swimming. In the past, the wearer's foot was held in the pocket either by means of a rubber heel strap with a buckle or a one-piece molded shoe-like receptacle.

The problem with the shoe-like receptacle is that it cannot be adjusted to fit different size feet. The use of an adjustable heel strap has this advantage, however the strap has a tendency to slip out of adjustment and there is a further disadvantage that there are loose straps which can hang-up on objects under water and cause problems. Furthermore, rubber straps tend to deteriorate with time and usage due to the elements and become weaker loosing their elasticity.

A further more serious problem exists with both of the approaches in the prior art. Thermal problems arising from exposure to cold water constitute a hazard for divers. Therefore, divers protect themselves by wearing insulated diving suits. These suits typically include foam rubber insulated boots. The boots are inserted in the pockets of the swim fins and held in by means of the rubber straps. As the diver descends the change in water pressure causes the rubber foam boot to collapse from the increased water pressure. This requires that the rubber strap be readjusted as the rubber strap will not take up enough for the increase in depth.

SUMMARY OF THE INVENTION

It is therefore an object of the present invention to provide a foot retaining means for a swim fin which will adapt automatically to any size foot and will also maintain a constant pressure at any diving depth.

Briefly, the above object is accomplished in accordance with the invention by providing a flat rate tensioning means such as a spring which is secured to each side of the foot pocket on the swim fin. The wearer's foot is held in the pocket by pressure of the spring on the back heel portion of the foot. In accordance with a feature of the present invention a limit stop is provided by a nonstretchable cord placed within the spring and secured to the sides of the pocket, the length of the cord being such that the spring is prevented from being stretched beyond its elastic limit.

The invention has the advantage that the heel retainer is self-adjusting and maintains a firm fit for any size foot at any diving depth.

A further advantage is that a stainless steel spring will not deteriorate over a long period of time as was the case with respect to rubber straps utilized for this purpose in the past.

The invention has an advantage over prior rubber straps in that no buckles need be adjusted, nor are there any loose straps to hang up on underwater objects. Furthermore, it is not necessary to adjust a buckle as the spring maintains a constant pressure over a wide range. Since the invention does not utilize a buckle and strap arrangement, no slippage is possible as there is in the case of a rubber strap and buckle.

The invention has the further advantage that as a swimmer descends and his rubber foam boot collapses from the increased water pressure, the spring heel retainer of the present invention adjusts automatically to maintain a uniform pressure.

Another advantage of the invention is that the swim fin is easier to put on because of the ease of extending the spring. It is not necessary to undo any buckles as was the case in the past.

A further advantage of the invention is that by placing a nylon cord inside the spring a limit stop on the amount of stretch is provided so that stretching the spring beyond its elastic limit and destroying its tensionability is prevented.

The foregoing and other objects, features and advantages of the invention will be apparent from the following more particular description of a preferred embodiment of the invention as illustrated in the accompanying drawings.

DESCRIPTION

Figure 1:
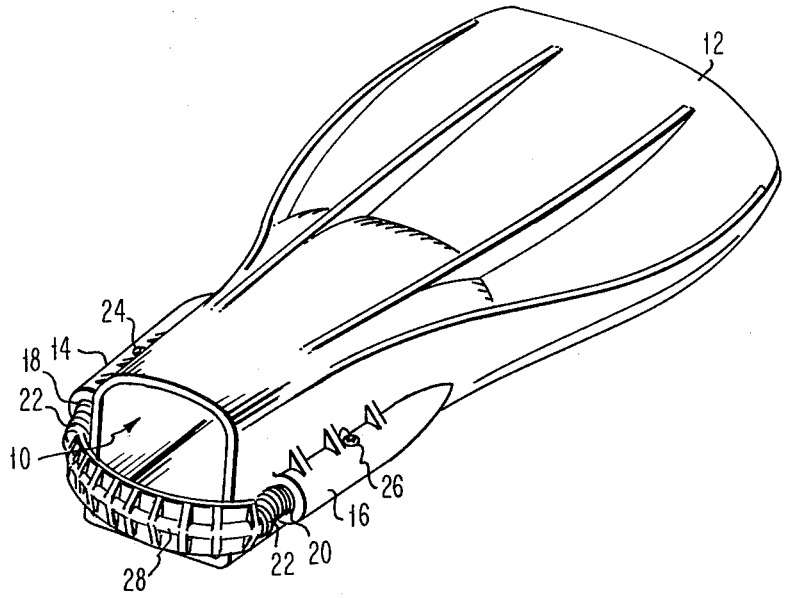
FIG. 1 is a perspective view of a swim fin constructed in accordance with the present invention.

Referring now to FIG. 1 the swim fin includes a foot pocket 10 and a blade 12 extending forward from the foot pocket. In accordance with the present invention spring receptables 14, 16 are molded onto the side walls of the foot pocket 10. The spring receptacles 14, 16 have holes 18, 20 therein for receiving the ends of a spring 22. Bolts 24, 26 pass down through the receptacles 14, 16 and through a loop at each end of the spring 22 to thus secure the spring to the receptacle.

A molded neoprene heel pad sleeve 28 is provided with a hole passing therethrough to receive the spring. The pad protects the user's finger and heel from being pinched by the coils of the spring.

Figure 2:
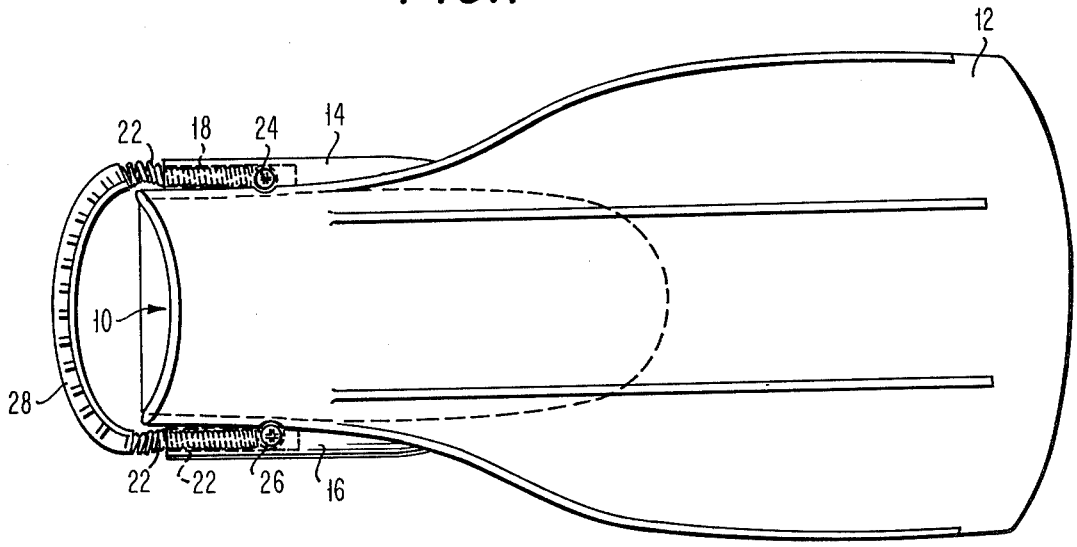
FIG. 2 is a plan view of the embodiment of FIG. 1.
Figure 3:
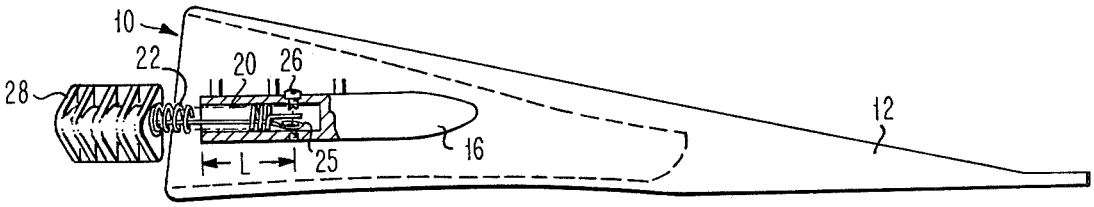
FIG. 3 is a side elevation of the embodiment of FIG. 1.

As shown more clearly in FIGS. 2 and 3, a limit stop cord 23, such as nylon, is provided extending through the spring. The cord is provided with a loop 25 knotted at both ends which is looped around the bolts 24, 26. The length of the cord is chosen such that when the spring is extended the cord will stop the extension thereof short of the spring reaching its elastic limit. This prevents undue stretching of the spring which would destroy its tensioning ability. This safety feature is important as it prevents the user from damaging the heel retaining mechanism while putting the fin on.

The depth of the receptacles 18, 20 is chosen so that a substantial portion of the spring can be placed therein. By doing this a wide range of foot sizes is accommodated while still maintaining a very flat rate of tension provided by the spring. Thus, the length L from the end of the receptacle to the bolt hole shown in FIG. 3 is chosen such that the spring can be stretched to accommodate any reasonable size of foot. By way of example, a 10¼ inch stainless steel coil spring of ½ inch coil diameter, and 0.062 wire diameter with 150 coils is suitable. In this case, the length L should be about 2 inches for good results.

Since the spring is relatively long and has closely wound coils, the curve of a plot of force versus length doesn't rise steeply, that is the spring has a relatively flat rate. By way of example, when a pre-load of 10 lbs. is applied to the spring, an additional force of 15 lbs. is required to stretch the spring a distance of 2¼ inches. This is approximately the amount of force necessary to slip the heel retainer over the heel of one's foot. For comparison, 35 lbs. of additional force would be required to stretch a rubber strap the same distance.

The embodiment described above uses a single spring passing through the heel pad. It should be understood that two springs with a loop at each end and secured by one bolt or two separate bolts in the heel pad could be utilized. In this case, two cords would be necessary, each tied at a bolt in the heel pad and a bolt 24, 26 in the receptacles 14, 16.

While the invention has been particularly shown and described with reference to a preferred embodiment thereof, it will be understood by those skilled in the art that various changes in form and details may be made therein without departing from the spirit and scope of the invention.

What is claimed is:

1. For use with a swim fin having a pocket for receiving a wearer's foot, foot retaining means comprising:

at least one coil spring having a substantially flat expansion rate and a loop at each end thereof;

receptacles secured to each side of said pocket, each receptacle including an opening therein for receiving one end of said spring; and means passing through said loops and said receptacles for securing said spring to said pocket such that the wearer's foot is held in said pocket by pressure of said spring on the back of the wearer's foot.

2. The combination in accordance with claim 1 including a limit stop cooperating with said coil spring to limit the stretch of said spring so that said spring cannot be stretched beyond the elastic limit thereof.

3. The combination in accordance with claim 2 wherein said limit stop is a substantially nonstretchable cord threaded within said spring, said cord being adapted to be secured to the sides of said pocket, the length of said cord being such that said cord prevents said spring from being stretched beyond its elastic limit.

4. The combination comprising:

a swim fin body including a foot opening for receiving the toe end of a foot, first and second receptacles on opposite sides of said opening, said receptacles being hollow and having an opening in one end thereof, said receptacles each having a hole passing therethrough perpendicular to the opening therein;

a coil spring having a first loop on one end thereof and a second loop on the other end thereof;

a heel pad having a hole passing therethrough for receiving said spring;

a first bolt passing through the hole of said first receptacle and said first loop of said spring; and a second bolt passing through the hole of said second receptacle and the second loop of said spring;

whereby said spring is secured in said first receptacle, passes through said heel pad and is secured in said second receptacle to thereby provide a loop across said foot opening to thereby retain a foot in said opening by pressure of said heel pad on the heel of said foot.

* * * * *